US010118269B2

(12) United States Patent
Pan et al.

(10) Patent No.: US 10,118,269 B2
(45) Date of Patent: Nov. 6, 2018

(54) SELF-SHARPENING POLISHING DEVICE WITH MAGNETORHEOLOGICAL FLEXIBLE POLISHING PAD FORMED BY DYNAMIC MAGNETIC FIELD AND POLISHING METHOD THEREOF

(71) Applicant: GUANGDONG UNIVERSITY OF TECHNOLOGY, Guangzhou (CN)

(72) Inventors: Jisheng Pan, Guangzhou (CN); Qiusheng Yan, Guangzhou (CN); Weiqiang Gao, Guangzhou (CN); Peng Yu, Guangzhou (CN)

(73) Assignee: GUANGDONG UNIVERSITY OF TECHNOLOGY, Guangzhou (CN)

( * ) Notice: Subject to any disclaimer, the term of this patent is extended or adjusted under 35 U.S.C. 154(b) by 34 days.

(21) Appl. No.: 15/519,005

(22) PCT Filed: Jan. 27, 2016

(86) PCT No.: PCT/CN2016/072318

§ 371 (c)(1),
(2) Date: Apr. 13, 2017

(87) PCT Pub. No.: WO2017/084211

PCT Pub. Date: May 26, 2017

(65) Prior Publication Data

US 2018/0021910 A1 Jan. 25, 2018

(30) Foreign Application Priority Data

Nov. 18, 2015 (CN) ..... 2015 1 0801886

(51) Int. Cl.

| | |
|---|---|
| ***B24B 1/00*** | (2006.01) |
| ***B24B 47/12*** | (2006.01) |
| ***B24B 53/02*** | (2012.01) |

(52) U.S. Cl.
CPC ..... *B24B 1/005* (2013.01); *B24B 1/00* (2013.01); *B24B 47/12* (2013.01); *B24B 53/02* (2013.01); *H05K 999/99* (2013.01)

(58) Field of Classification Search
CPC ..... B24B 1/005; B24B 53/02; B24B 47/12; H05K 999/99

(Continued)

(56) References Cited

U.S. PATENT DOCUMENTS 4,211,041 A * 7/1980 Sakulevich ..... B24B 1/005 451/113
4,726,150 A * 2/1988 Nishio ..... B24B 7/16 451/271

(Continued)

FOREIGN PATENT DOCUMENTS

CN 100999061 A 7/2007
CN 100486765 C 5/2009

(Continued)

OTHER PUBLICATIONS

International Search Report from International Application No. PCT/CN2016/072318, dated Aug. 24, 2016, 2 pages.

*Primary Examiner* — George Nguyen
(74) *Attorney, Agent, or Firm* — JCIPRNET

(57) ABSTRACT

Provided is a self-sharpening polishing device with magnetorheological flexible polishing pad formed by dynamic magnetic field and polishing method thereof. The device includes a polishing disc revolution mechanism and a multi-magnetic-pole synchronous rotary drive mechanism, the polishing disc revolution mechanism including a transmission shaft motor, a transmission shaft, a transfer disc, an eccentric shaft fixing disc, a cup-shaped polishing disc and a transmission shaft transmission mechanism, the multi-magnetic-pole synchronous rotary drive mechanism including an eccentric spindle, a synchronous rotary drive disc, flexible eccentric rotating shafts, eccentric sleeves, magnetic (Continued)

poles, the eccentric shaft fixing disc, and a spindle motor, etc. The device does not need a circulating device to renew magnetorheological fluid and does not need to renew the magnetorheological fluid during the finishing process; in fact the entire process from rough polishing to precise polishing can be done at one time. The device maintains a consistent workpiece surface and delivers a low cost and very efficient polishing process that is eminently suitable for the planes of optical elements with large diameter; it is also suitable for studying the material removal mechanism of planar optical materials and detecting sub-surface damage, as well as other experimental studies.

10 Claims, 7 Drawing Sheets

(58) Field of Classification Search
USPC ..... 451/56
See application file for complete search history.

(56) References Cited

U.S. PATENT DOCUMENTS 5,449,313 A * 9/1995 Kordonsky ..... B24B 1/005 451/104
5,616,066 A * 4/1997 Jacobs ..... B24B 1/005 451/113
5,791,976 A * 8/1998 Honda ..... B24B 7/04 451/271
6,139,404 A * 10/2000 Yau ..... B24B 37/04 451/443
6,336,855 B1 * 1/2002 Ohmori ..... B24B 7/17 451/449
6,478,663 B1 * 11/2002 Ganser ..... B24B 17/00 451/271
6,514,129 B1 * 2/2003 Halley ..... B24B 9/065 451/270
8,480,458 B2 * 7/2013 White, Jr. ..... B24B 7/17 451/269
2004/0214514 A1 * 10/2004 Elledge ..... B24B 37/12 451/59

FOREIGN PATENT DOCUMENTS

CN 103072069 A 5/2013
CN 205237716 U 5/2016
JP H11333677 A 12/1999

* cited by examiner

SELF-SHARPENING POLISHING DEVICE WITH MAGNETORHEOLOGICAL FLEXIBLE POLISHING PAD FORMED BY DYNAMIC MAGNETIC FIELD AND POLISHING METHOD THEREOF

TECHNICAL FIELD

The present invention relates to a self-sharpening polishing device with magnetorheological flexible polishing pad formed by dynamic magnetic field and polishing method thereof, which would suit the planarization of the planes of an optoelectronic or microelectronic semi-conductor substrate and optical elements. This means it belongs to the technical field of ultra-precision finishing.

BACKGROUND

Since optical elements (lenses, mirrors) are one of the core elements of optical devices, their surface accuracy must be ultra-smooth (roughness: Ra is below 1 nm), and they must also have a relatively high surface figure (the shape accuracy is below 0.5 microns), to achieve excellent optical performance. In the LED field, monocrystalline silicon (Si), monocrystalline germanium (Ge), gallium arsenide (GaAs), monocrystalline silicon carbide (SiC), and sapphire ($Al_2O_3$) etc., serve as semi-conductor substrate materials, so they must also have an ultra-flat and ultra-smooth surface (roughness of Ra must below 0.3 nm) in order to meet the growth of epitaxial film and, there must be no defects and no damage. Flat optical elements and the semi-conductor substrate both need planarization, but the conventional processes for planarizing flat optical elements and semiconductor substrates are mainly surface grinding, ultra-precision polishing, chemical mechanical polishing, and magnetorheological polishing; this means the quality and precision of the finishing method determines how well optical devices and semi-conductor devices perform.

Magnetorheological finishing is a new method for finishing an optical surface; it was put forward by KORDONSKI and his collaborators in the 1990s, and is based on a combination of electromagnetics, fluid dynamics, analytical chemistry, and processing technology, etc. Magnetorheological finishing is good for polishing and there is no secondary surface damage, so it is suitable for finishing complex surfaces, unlike traditional polishing processes. Magnetorheological finishing has since developed into a revolutionary finishing method for optical surfaces, particularly for finishing axisymmetric aspheric surfaces, so it is widely used in the final processing of large-scale optical elements, semi-conductor wafers, LED substrates, and liquid crystal display panels, etc. However, current magnetorheological finishing used to finish flat workpieces is mainly using the various models of magnetorheological finishing machines developed by QED, a corporation from the United States. These machines work by placing the workpiece above an arc-shaped polishing disc such that a concave gap is formed between the surface of the workpiece and the polishing disc. An electromagnet pole or a permanent magnet pole with an adjustable magnetic flux density is placed under the polishing disc to form a high-intensity gradient magnetic field at the concave gap. As the magnetorheological fluid moves with the polishing disc to a position adjacent to the concave gap formed by the workpiece and the polishing disc, a flexible protruding "polishing ribbon" is formed. However, contact between the "polishing ribbon" and the workpiece surface belongs to "spots" local contact.

During the finishing process, only by controlling the "spots" to perform trajectory scanning along the workpiece surface according to a certain rule, can the entire surface be finished. This trajectory scanning process requires a lot of time which means it is inefficient and it is not easy to guarantee an accurate finishing shape.

To improve the efficiency of magnetorheological finishing, Patent No. CN200610132495.9 sets forth an abrasive polishing method based on the magnetorheological effect and a polishing device thereof, which works on the principle of magnetorheological finishing and an action mechanism of cluster; this process has already been carried out in a large number of experimental studies. Although this method forms a regional polishing pad using the cluster method, it is difficult to finish the workpiece uniformly, so following a deep analysis, it is found that due to the viscoelasticity of magnetorheological fluid, the workpiece will press down the protruding flexible polishing pad set forth in the patent and make it irrecoverable when passing by the flexible polishing pad. Thus, the flexible polishing pad loses its pressure on the workpiece, which makes a huge difference between the material removal rate at the edge of a workpiece and that in other areas. Moreover it is difficult to renew the abrasive in the viscoelastic polishing pad which further reduces the finishing effect (as shown in FIG. 1). Therefore, based on this deep research, the present invention has a self-sharpening polishing device with magnetorheological flexible polishing pad formed by dynamic magnetic field and polishing method thereof, which intuitively maintains constant pressure during the finishing process and enables the abrasive to be renewed, whilst simultaneously self-sharpening in real time during this process. This finishing device and finishing method are eminently suitable for high-efficiency ultra-precision finishing of optical elements, semiconductor wafers, ceramic substrates, and other flat materials.

SUMMARY

One object of this invention is to provide a self-sharpening polishing device with magnetorheological flexible polishing pad formed by dynamic magnetic field, which focuses on the non-uniformity of cluster magnetorheological finishing. This invention is extremely efficient at finishing, it is low cost and there is no surface or sub-surface damage, which makes it suitable for the high-efficiency ultra-precision finishing for the planes of optoelectronic or microelectronic semiconductor substrate and optical elements.

Another object of this invention is to provide a polishing method of the self-sharpening polishing device with magnetorheological flexible polishing pad formed by dynamic magnetic field. This invention realizes the self-sharpening of abrasive gathered on the surface of the magnetorheological flexible polishing pad, while recovering the shape of a magnetorheological flexible polishing pad via the regular movement of the magnetic pole array forming a dynamic magnetic field; this will maintain and improve the finishing performance of the magnetorheological flexible polishing pad, improve the efficiency of magnetorheological polishing, and realizes uniform finishing of the workpiece.

The technical solution of the present invention is that: a self-sharpening polishing device with magnetorheological flexible polishing pad formed by dynamic magnetic field of the present invention, comprises a polishing disc revolution mechanism and a multi-magnetic-pole synchronous rotary drive mechanism, the polishing disc revolution mechanism comprising a base, a transmission shaft motor, a transmission shaft, a transfer disc, an eccentric shaft fixing disc, a cup-shaped polishing disc and a transmission shaft transmission mechanism, the multi-magnetic-pole synchronous rotary drive mechanism comprising an eccentric spindle, a synchronous rotary drive disc, flexible eccentric rotating shafts, eccentric sleeves, magnetic poles, the eccentric shaft fixing disc, a spindle motor, a spindle transmission mechanism, wherein the transmission shaft motor is fitted onto the base, a driving transmission member of the transmission shaft transmission mechanism is fitted onto an output shaft of the transmission shaft motor, a driven transmission member of the transmission shaft transmission mechanism is connected to the transmission shaft, the transfer disc is fitted coaxially onto an upper end face of the transmission shaft, the eccentric shaft fixing disc is fitted coaxially onto an upper end face of the transfer disc, the cup-shaped polishing disc is fitted coaxially onto an upper end face of the eccentric shaft fixing disc, the spindle motor of the multi-magnetic-pole synchronous rotary drive mechanism is fitted onto the base, a driving transmission member of the spindle transmission mechanism is fitted onto an output shaft of the spindle motor, a driven transmission member of the spindle transmission mechanism is connected to the eccentric spindle, the eccentric spindle is mounted in a hollow cavity inside the transmission shaft, the synchronous rotary drive disc is fitted onto an upper end of the transmission shaft, the flexible eccentric rotating shaft is installed on an upper end of the synchronous rotary drive disc, the eccentric sleeve is fitted onto the flexible eccentric rotating shaft, the magnetic pole is fitted inside the eccentric sleeve, and the flexible eccentric rotating shaft is mounted inside a shaft hole provided in the cup-shaped polishing disc.

A polishing method of the self-sharpening polishing device with magnetorheological flexible polishing pad formed by dynamic magnetic field of the present invention, comprises steps of:

1) selecting magnetic poles with appropriate diameter and magnetic field strength based on characteristic of the object to be finished, installing the magnetic poles in the self-sharpening polishing device with magnetorheological flexible polishing pad formed by dynamic magnetic field, adjusting the angle of the eccentric sleeves based on requirements such that all the magnet rotating eccentric distances are consistent;

2) installing a workpiece onto a tool head, with a lower surface of the workpiece being parallel to an upper end face of the cup-shaped polishing disc, adjusting a gap between the lower surface of the workpiece and the cup-shaped polishing disc to range from 0.5 mm to 5 mm;

3) adding at least two of the following three abrasives the into deionized water, wherein the three abrasives are micron-grade abrasive with a concentration ranging from 2 wt % to 15 wt %, sub-micron abrasive with a concentration ranging from 2 wt % to 15 wt % and nanoscale abrasive with a concentration ranging from 2 wt % to 15 wt %, adding sub-micron carbonyl iron powder with a concentration ranging from 2 wt % to 20 wt % and micron-grade carbonyl iron powder with a concentration ranging from 3% wt to 15 wt % into the deionized water, and adding a dispersing agent with a concentration ranging from 3 wt % to 15 wt % and anti-rusting agent with a concentration of ranging from 1 wt % to 6 wt %, stirring the deionized water thoroughly, and then ultrasonically vibrating the deionized water for 5 to 30 minutes to form magnetorheological fluid;

4) pouring the magnetorheological fluid into the cup-shaped polishing disc, starting the spindle motor to drive the eccentric spindle to rotate, the rotation of the drive bearing forcing the synchronous rotary drive disc to swing, the swing of the synchronous rotary drive disc forcing each flexible eccentric rotating shaft to realize rotate simultaneously, the rotation of the flexible eccentric rotating shaft forcing the magnetic pole to rotate under the magnet rotating eccentric distance so as to realize the transition from the dynamic magnetic field to the static magnetic field at the end face of the magnetic pole, the magnetorheological fluid forming a flexible polishing pad with abrasive real-time renewing and self-sharpening and shape recovering under the effect of the dynamic magnetic field;

5) starting the transmission shaft motor to drive the cup-shaped polishing disc to rotate at a high speed, driving the tool head to rotate at a high speed and swing in low speed to realize the high-efficiency, ultra-smooth and uniform polishing of surface material of the workpiece.

This self-sharpening polishing device with magnetorheological flexible polishing pad formed by dynamic magnetic field of the present invention transforms the static magnetic field into a dynamic magnetic field by means of the eccentric rotation of magnetic poles; this rearranges the magnetic chain in the flexible polishing pad and the abrasive becomes self-sharpening and the polishing pad recovers in real time. These actions solve the core problem whereby a polishing pad formed by a static magnetic field loses its finishing pressure on the workpiece during operation because the polishing pad deforms due to viscosity and magnetism of the magnetorheological fluid. This invention allows the magnetic pole to dynamically adjust its rotating eccentric distance by the cooperation between the eccentric hole in the flexible eccentric rotating shaft and the eccentric sleeve, and use the multi-magnetic-pole synchronous rotary drive mechanism to enable a close arrangement of the numerous synchronous rotary magnetic poles. Theoretically, this invention can form a large, flexible and compact polishing pad that can polish the plane of optical elements with large diameter. Another advantage of this invention is using a dynamic magnetic field to renew the magnetorheological fluid; it does not need to use a circulating device to renew magnetorheological fluid or renew it during the finishing process. This not only saves space due to not needing finishing equipment, it also solves the problem with conventional magnetorheological finishing where residue adheres to the circulating device and contaminates the magnetorheological fluid. Furthermore, this invention will not affect the internal structure of the self-sharpening polishing device when the cup-shaped polishing disc is installed and removed. In fact removing the cup-shaped polishing disc for cleaning is easy because there is no effect from magnetism. The magnetorheological fluid prepared for this invention belongs to mixed fluid flow with mixed thickness. The fluidity and material removal capacity of the magnetorheological fluid is realized by adjusting the gap between the upper surface of the workpiece and the cup-shaped polishing disc, in fact the entire process from rough to precise polishing can be done at one time. Furthermore, this invention can maintain a consistent finish of the workpiece surface because it is efficient and low cost, and there is no surface or sub-surface damage, which makes it suitable for polishing optical elements with large diameter. This invention is also suitable for studying the material removal mechanism of planar optical materials and detecting sub-surface damage, as well as other experimental studies.

BRIEF DESCRIPTION OF THE DRAWINGS

FIGS. 1-7 show the following:

1. cup-shaped polishing disc, 2. first fixing screw, 3. eccentric shaft fixing disc, 4. second fixing screw, 5. drive disc end cap, 6. radial-thrust bearing, 7. outer spacer bushing, 8. synchronous rotary drive disc, 9. shaft end cap, 10. third fixing screw, 11. transfer disc, 12. fourth fixing screw, 13. transmission shaft, 14. bearing end cap, 15. fifth fixing screw, 16. bearing block, 17. spindle motor, 18. sixth fixing screw, 19. flexible eccentric rotating shaft, 20. eccentric sleeve, 21. magnetic pole, 22. deep groove ball bearing, 23. seventh fixing screw, 24. spindle end cap, 25. drive bearing, 26. separation sleeve, 27. eighth fixing screw, 28. eccentric spindle end cap, 29. ninth fixing screw, 30. spindle bearing, 31. inner sleeve, 32. outer sleeve, 33. transmission shaft bearing, 34. inner fixing sleeve, 35. outer fixing sleeve, 36. bearing block, 37. transmission shaft motor, 38. tenth fixing screw, 39. base, 40. spindle driving belt wheel, 41. first flat key, 42. spindle transmission belt, 43. eccentric spindle, 44. eleventh fixing screw, 45. spindle driven belt wheel, 46. twelfth fixing screw, 47. transmission shaft driven belt wheel, 48. transmission shaft transmission belt, 49. second flat key, 50. transmission shaft driving belt wheel, 51. eccentric distance of the eccentric spindle, 52. eccentric distance of the flexible eccentric rotating shaft, 53. magnet rotating eccentric distance, 54. thin notch, 55. eccentric hole, 56. boss, 57. eccentricity of the eccentric hole, 58 small eccentric shaft, 59. lower flange block, 60. upper flange block, 61. workpiece, 62. tool head, 63. magnetorheological fluid, 64. flexible polishing pad, 65. circulating device.

DETAILED DESCRIPTION

This invention will be further described with reference to the accompanying drawings and embodiments, but the actual process that can be realized is not limited to these embodiments:

Embodiment 1

Figure 3:
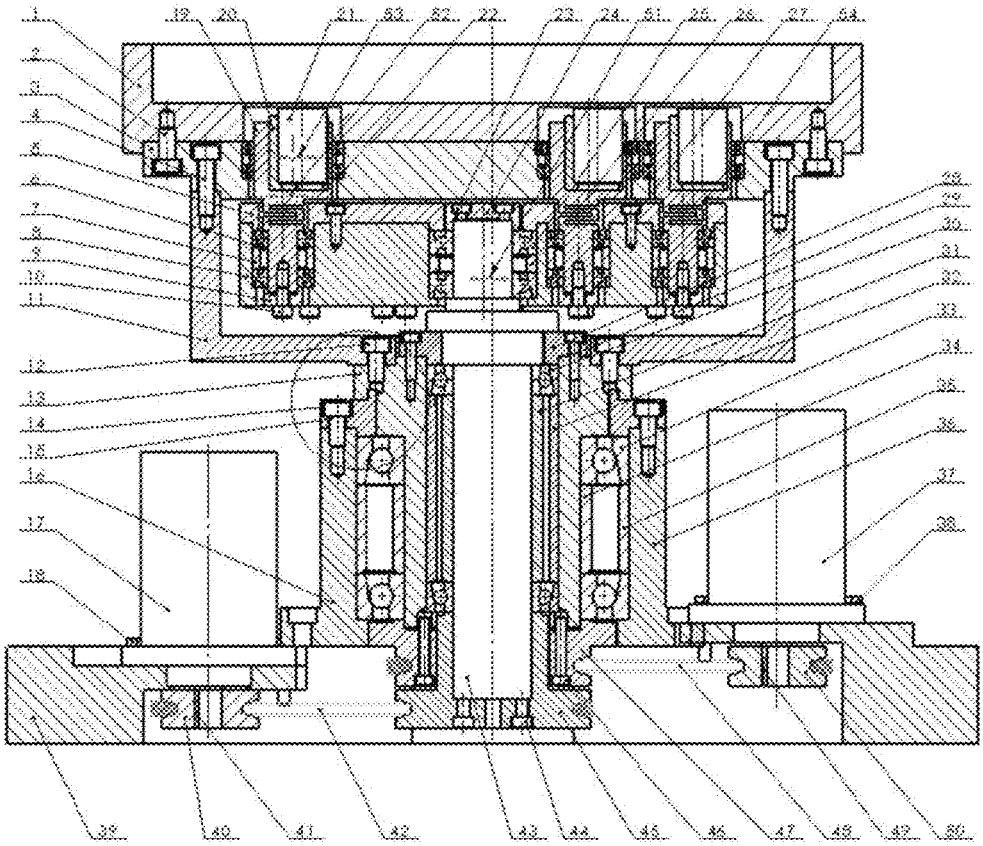
FIG. 3 is a cross-sectional view of the self-sharpening polishing device with magnetorheological flexible polishing pad formed by dynamic magnetic field of the present invention.

FIG. 3 shows a self-sharpening polishing device with magnetorheological flexible polishing pad formed by dynamic magnetic field which comprises a polishing disc revolution mechanism and a multi-magnetic-pole synchronous rotary drive mechanism. The polishing disc revolution mechanism comprises a base 39, a transmission shaft motor 37, a transmission shaft 13, a transfer disc 11, an eccentric shaft fixing disc 3, a cup-shaped polishing disc 1 and a transmission shaft transmission mechanism. The multi-magnetic-pole synchronous rotary drive mechanism comprises an eccentric spindle 43, a synchronous rotary drive disc 8, flexible eccentric rotating shafts 19, eccentric sleeves 20, magnetic poles 21, the eccentric shaft fixing disc 3, a spindle motor 17, a spindle transmission mechanism wherein the transmission shaft motor 37 is fitted onto the base 39, a driving transmission member of the transmission shaft transmission mechanism is fitted onto an output shaft of the transmission shaft motor 37, a driven transmission member of the transmission shaft transmission mechanism is connected to the transmission shaft 13, the transfer disc 11 is fitted coaxially onto fitted upper end face of the transmission shaft 13, the eccentric shaft fixing disc 3 is fitted coaxially onto the upper end face of the transfer disc 11, the cup-shaped polishing disc 1 is fitted coaxially onto an upper end face of the eccentric shaft fixing disc 3, the spindle motor 17 of the multi-magnetic-pole synchronous rotary drive mechanism is fitted onto the base 39, a driving transmission member of the spindle transmission mechanism is fitted onto the output shaft of the spindle motor 17, a driven transmission member of the spindle transmission mechanism is connected to the eccentric spindle 43, the eccentric spindle 43 is mounted in a hollow cavity inside the transmission shaft 13, the synchronous rotary drive disc 8 is fitted onto the upper end of the transmission shaft 13, the flexible eccentric rotating shaft 19 is installed onto an upper end of the synchronous rotary drive disc 8, the eccentric sleeve 20 is fitted onto the flexible eccentric rotating shaft 19, the magnetic pole 21 is fitted inside the eccentric sleeve 20, and the flexible eccentric rotating shaft 19 is mounted in a shaft hole inside the cup-shaped polishing disc 1.

In this embodiment, said spindle transmission mechanism comprises a spindle driving belt wheel 40, a spindle transmission belt 42, and a spindle driven belt wheel 45, wherein the spindle driving belt wheel 40 is mounted on the output shaft of the spindle motor 17, the spindle driven belt wheel 45 is mounted on the eccentric spindle 43, and the spindle transmission belt 42 is wound around the spindle driving belt wheel 40 and the spindle driven belt wheel 45.

In this embodiment the transmission shaft transmission mechanism comprises a transmission shaft driving belt wheel 50, a transmission shaft driven belt wheel 47, and a transmission shaft transmission belt 48, wherein the transmission shaft driving belt wheel 50 is mounted on an output shaft of the transmission shaft 13, the transmission shaft driven belt wheel 47 is mounted on the transmission shaft 13, and the transmission shaft transmission belt 48 is wound around the transmission shaft driving belt wheel 50 and the transmission shaft driven belt wheel 47.

In this embodiment the transmission shaft motor 37 is fitted onto the base 39 by ten fixing screws 38, the transmission shaft driving belt wheel 50 is fitted onto the transmission shaft motor 37 by a second flat key 49, a bearing block 16 in which a pair of transmission shaft bearings 33 are installed is installed vertically at the centre of the base 39, a bearing end cap 14 is mounted on an end face of the bearing block 16 by fifth fixing screws 15 such that it presses against an outer ring of the transmission shaft bearing 33, an inner fixing sleeve 34 and an outer fixing sleeve 35 support and separate the transmission shaft bearings 33 on which the transmission shaft 13 is supported, the transfer disc 11 is fitted coaxially onto the upper end face of the transmission shaft 13 by fourth fixing screws 12, the eccentric shaft fixing disc 3 is fitted coaxially onto the upper end face of the transfer disc 11 by second fixing screws 4, the cup-shaped polishing disc 1 is fitted coaxially onto the upper end face of the eccentric shaft fixing disc 3 by first fixing screws 2, a transmission shaft driven belt wheel 47 is fitted onto a lower end face of the transmission shaft 13 by twelfth fixing screws 46, the eccentric spindle 43 of the multi-magnetic-pole synchronous rotary drive mechanism is fitted inside the hollow cavity in the transmission shaft 13 by a pair of spindle bearings 30, an inner sleeve 31, and an outer sleeve 32 position inner rings and outer rings of the spindle bearings 30, an eccentric spindle end cap 28 is fitted onto the upper end of the transmission shaft 13 by ninth by ninth fixing screws 29, such that it presses against the outer ring of the spindle bearing 30, a drive bearing 25 is fitted onto an end of an eccentric shaft of the eccentric spindle 43, a spindle end cap 24 is fitted onto an upper end of the eccentric shaft of the eccentric spindle 43 by seventh fixing screws 23 such that it presses against an inner ring of the drive bearing 25; the synchronous rotary drive disc 8 is fitted onto an outer ring of the drive bearing 25, radial-thrust bearings 6 are installed in arrayed holes of the synchronous rotary drive disc 8; outer spacer bushings 7 separate outer rings of the radial-thrust bearings 6, the flexible eccentric rotating shaft 19 is fixed by the radial-thrust bearing 6, a shaft end cap 9 is fitted onto a smaller end of the flexible eccentric rotating shaft 19 by third fixing screws 10, a drive disc end cap 5 is fitted onto the upper end of the synchronous rotary drive disc 8 by eighth fixing screws 27 such that it presses against an outer ring of the radial-thrust bearing 6, a deep groove ball bearing 22 is installed at a large upper end of the flexible eccentric rotating shaft 19, the eccentric sleeve 20 into which the magnetic pole 21 is fixed, is fitted into the eccentric hole of the large upper end of the eccentric rotating shaft 19, the deep groove ball bearings 22 are installed in the eccentric shaft fixing disc 3 by means of arrayed holes, the spindle driven belt wheel 45 is fitted onto a lower end of the eccentric spindle 43 by eleventh fixing screws 44 such that it presses against the spindle bearing 30, the spindle motor 17 is fitted onto the base 39 with a sixth fixing screw 18, and the spindle driving belt wheel 40 is fitted onto the spindle motor 17 by a first flat key 41.

Figure 6:
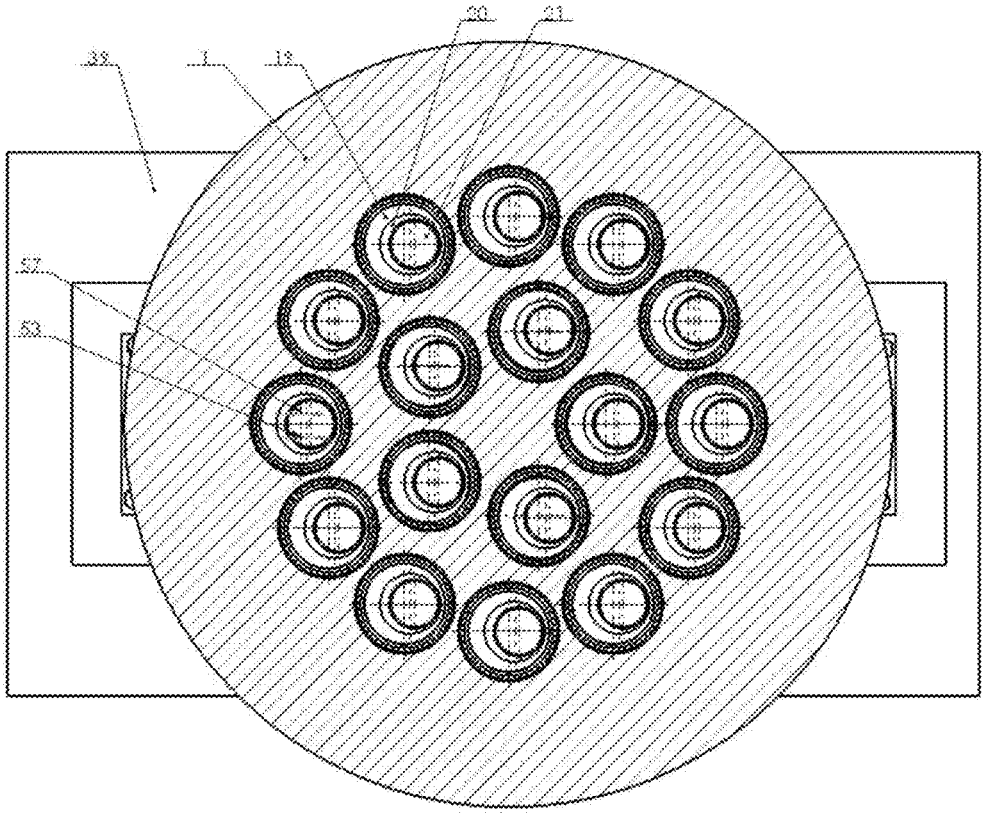
FIG. 6 is a schematic view of the installation of the magnet of the self-sharpening polishing device with magnetorheological flexible polishing pad formed by dynamic magnetic field of the present invention.

FIGS. 3 and 6 show that an eccentric distance 51 of the eccentric spindle and an eccentric distance 52 of the flexible eccentric rotating shaft 19 are equal in numerical value, and the eccentric directions of all the flexible eccentric rotating shafts 19 are consistent and are opposite to the eccentric direction of the eccentric spindle 43.

A rule of arrangement of the arrayed holes in the synchronous rotary drive disc 8 is equal to that of the arrayed holes in the eccentric shaft fixing disc 3; and a pitch-row of the arrayed holes in the synchronous rotary drive disc 8 is equal to that of the arrayed holes in the eccentric shaft fixing disc 3.

Figure 4:
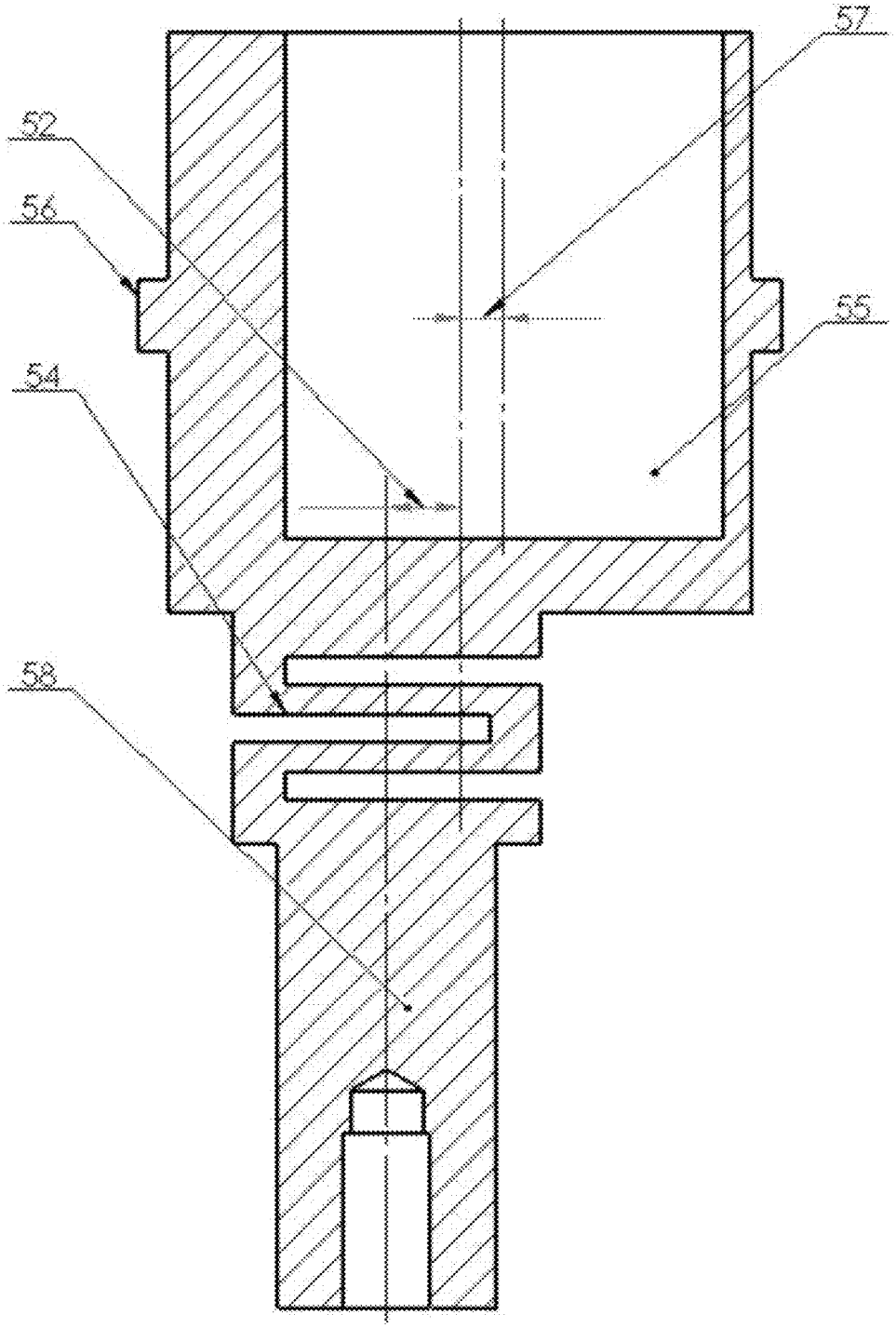
FIG. 4 is a cross-sectional view of the flexible eccentric rotating shaft the self-sharpening polishing device with magnetorheological flexible polishing pad formed by dynamic magnetic field of the present invention.

FIGS. 3 and 4 show that the outer cylinder of the flexible eccentric rotating shaft 19 has a boss 56, the outer cylinder an eccentric hole 55 inside, the eccentric distance 52 of the flexible eccentric rotating shaft is twice of an eccentricity 57 of the eccentric hole, and three or more staggered thin notches 54 is provided between the outer cylinder of the flexible eccentric rotating shaft 19, and a small eccentric shaft 58 of the flexible eccentric rotating shaft 19 to compensate for manufacturing error between the arrayed holes in the synchronous rotary drive disc 8 and the arrayed holes in the eccentric shaft fixing disc 3.

Figure 1:
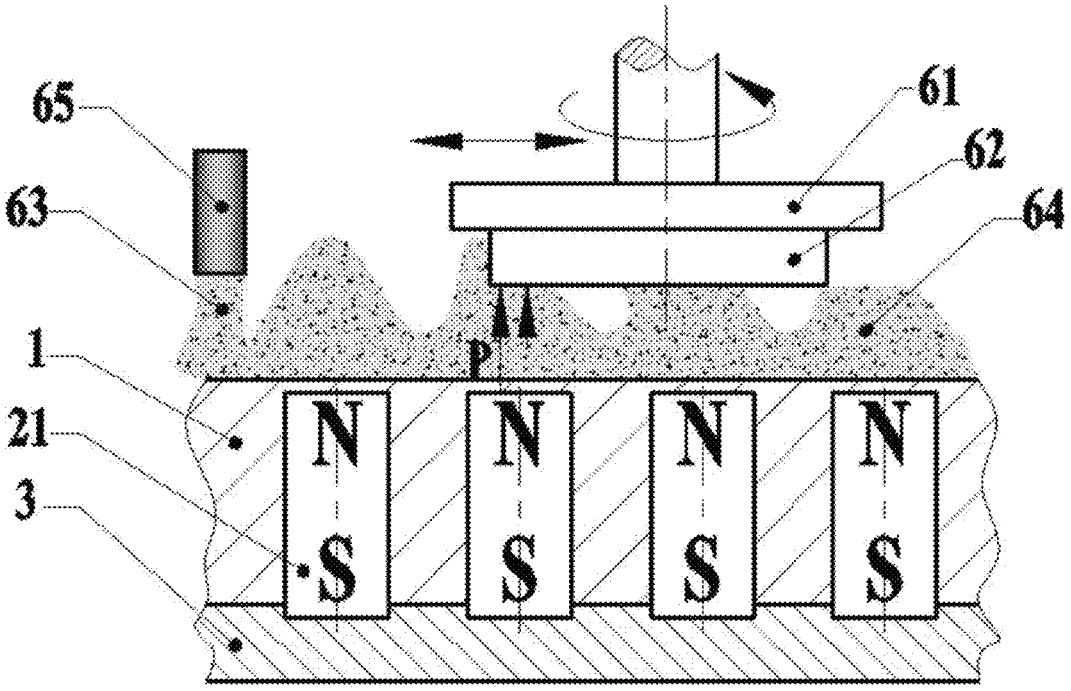
FIG. 1 is a schematic view showing how a conventional static magnetic field polishing pad operates.
Figure 2:
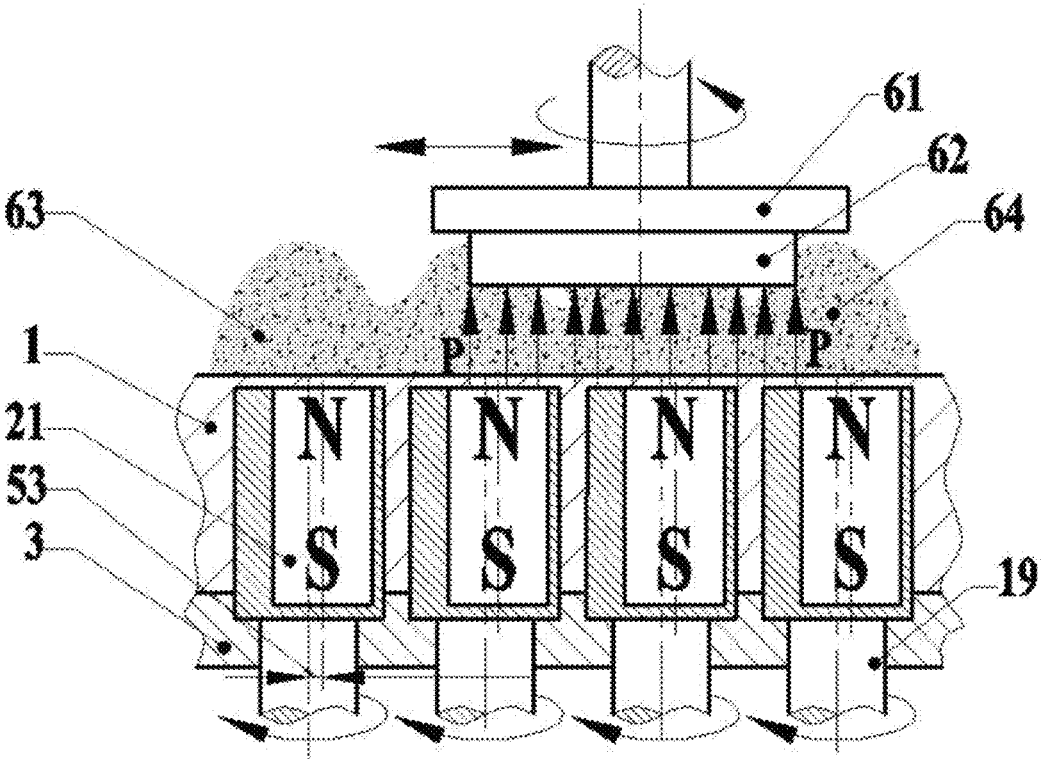
FIG. 2 is a schematic diagram of the self-sharpening polishing device with magnetorheological flexible polishing pad formed by dynamic magnetic field of the present invention.

FIGS. 2 and 3 show that an eccentricity 57 of the eccentric hole of the flexible eccentric rotating shaft 19 is equal to an eccentricity of the eccentric sleeve 20; it can change from 0 to twice of the eccentricity of the eccentric sleeve 20 by adjusting the angle of rotation of the eccentric sleeve 20, the angle of rotation of each eccentric sleeve 20 is consistent with that of each flexible eccentric rotating shaft 19; the rotation of the eccentric spindle 43 forces the synchronous rotary drive disc 8 to swing, the swing of the synchronous rotary drive disc 8 forces each flexible eccentric rotating shaft 19 to realize synchronizing rotation; and the rotation of the flexible eccentric rotating shaft 19 forces the magnetic pole 21 to rotate under a magnet eccentric distance 53 so as to realize the transition from a dynamic magnetic field to a static magnetic field at the end face of the magnetic pole 21.

Figure 5:
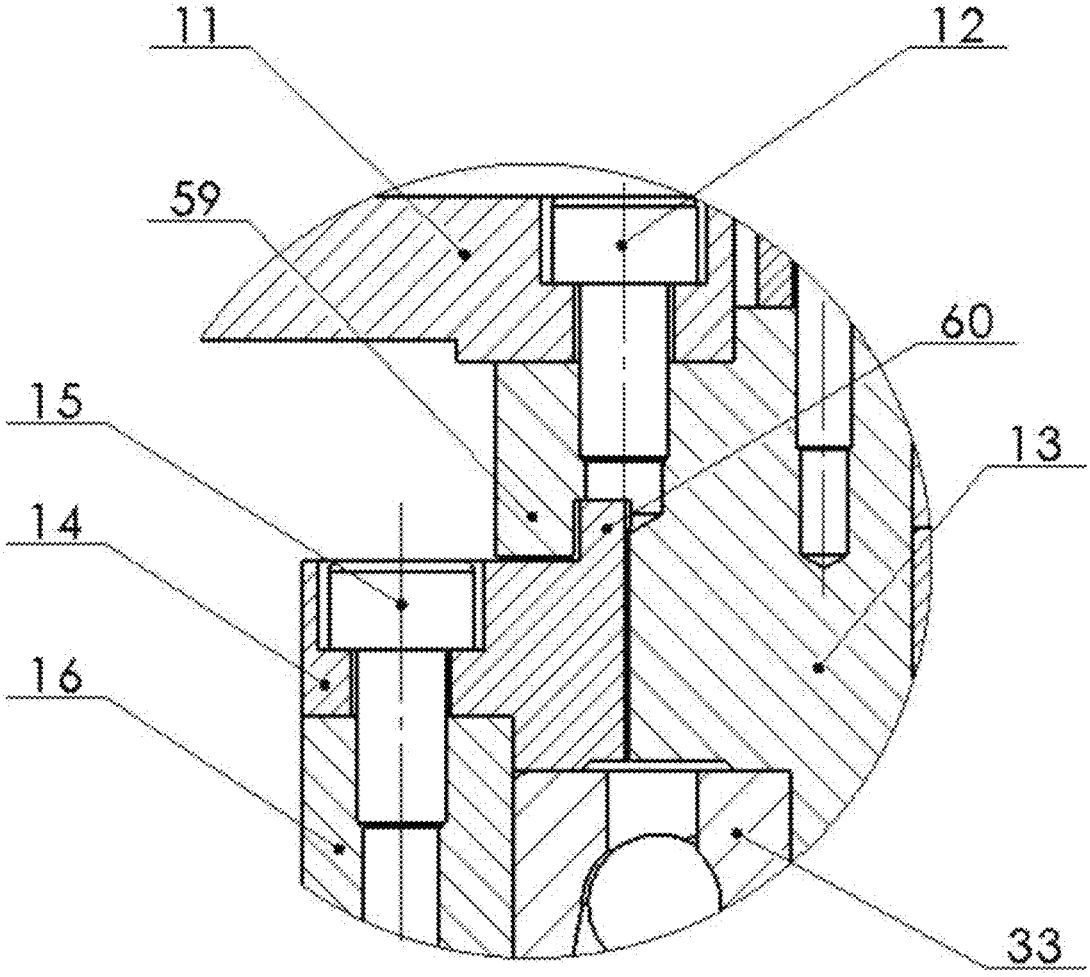
FIG. 5 is a partially enlarged view of the self-sharpening polishing device with magnetorheological flexible polishing pad formed by dynamic magnetic field of the present invention.

FIG. 5 shows that the transmission shaft 13 has a lower flange block 59 at the upper end, and the bearing end cap 14 has an upper flange block 60 in clearance fit with the lower flange block 59 to keep the transmission shaft bearing 33 waterproof and dustproof.

The magnetic poles 21 are cylindrical flat ends permanent magnet with and a minimum magnetic field strength of 500 Gs and a diameter ranging from 5 mm to 50 mm; the minimum number of magnetic poles 21 is one, the number of magnetic poles 21 is determined by the size of the object to be finished and the size of the cup-shaped polishing disc 1; the magnetic poles 21 are arranged in the eccentric shaft fixing disc 3 according to a certain rule such that the end faces of the magnetic poles 21 being kept in the same plane.

The cup-shaped polishing disc 1, the eccentric shaft fixing disc 3, the flexible eccentric rotating shafts 19, and the eccentric sleeves 20 can be made from diamagnetic materials, i.e., stainless steel, magnalium alloy, or ceramic.

Figure 7:
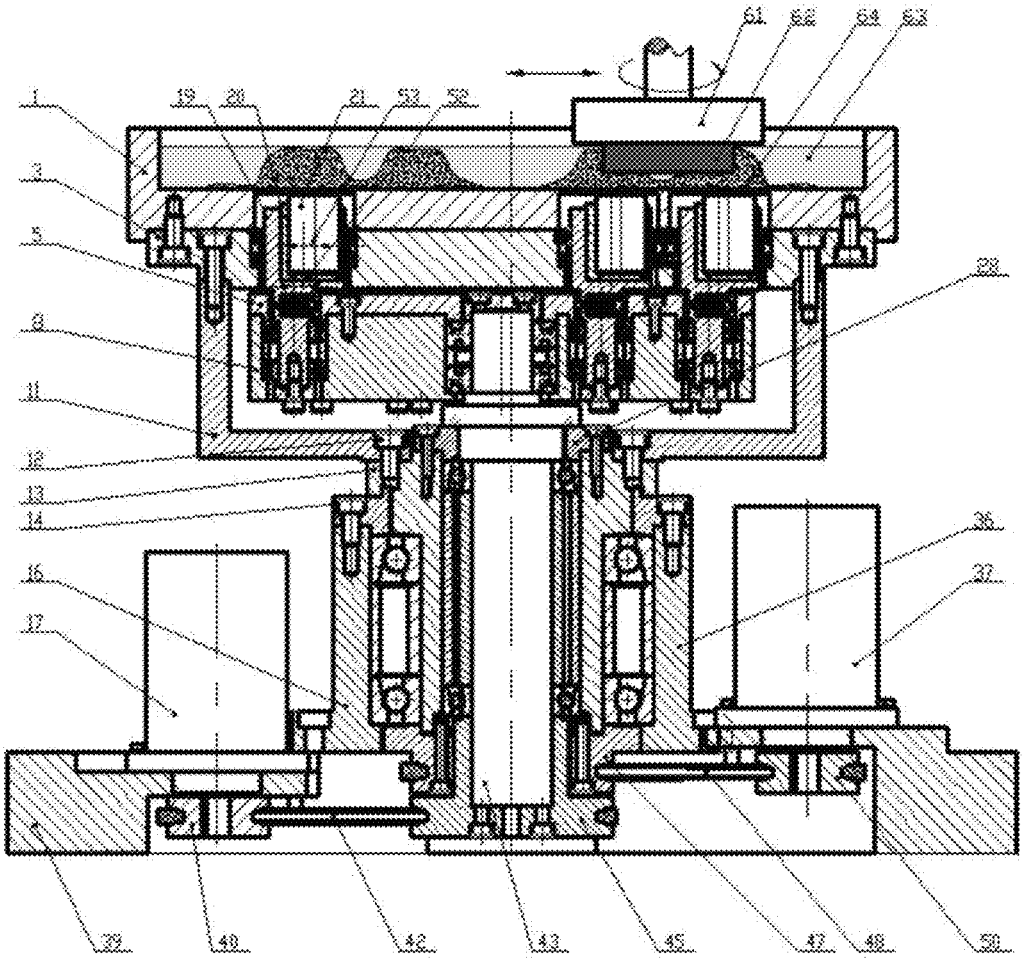
FIG. 7 is a schematic view of the finishing process of the self-sharpening polishing device with magnetorheological flexible polishing pad formed by dynamic magnetic field of the present invention.

FIG. 7 shows a polishing method of the self-sharpening polishing device with magnetorheological flexible polishing pad formed by dynamic magnetic field of present invention, comprises steps of:

1) selecting 48 magnetic poles 21 with a diameter of 20 mm and a magnetic field strength of 3200 Gs based on the characteristics of a single crystal silicon with a diameter of 150 mm, installing the 48 magnetic poles 21 into the self-sharpening polishing device magnetorheological flexible polishing pad formed by dynamic magnetic field by dividing them into three equi-distant annular rows, adjusting the angle of the eccentric sleeves 20 such that all the magnet rotating eccentric distances 53 are 3 mm;

2) installing the single crystal silicon with a diameter of 20 mm onto a tool head 62, with a lower surface of the workpiece 61 being parallel to an upper end face of the cup-shaped polishing disc 1, adjusting a gap between the lower surface of the workpiece 61 and the cup-shaped polishing disc 1 to be 1.5 mm;

3) adding aluminium abrasive with a particle size of 5 microns and a concentration of 3 wt % and aluminium abrasive with a particle size of 0.5 microns and a concentration of 2 wt % into deionized water, adding carbonyl iron powder with a particle size of 0.8 microns and a concentration of 4 wt % and carbonyl iron powder with a particle size of 0.8 microns and a concentration of 3 wt % into deionized water, and adding a dispersing agent with a concentration of 4 wt % and an anti-rusting agent with a concentration of 3 wt %, stirring the deionized water thoroughly, and then ultrasonically vibrating the deionized water for 20 minutes to form a magnetorheological fluid 63;

4) pouring the magnetorheological fluid 63 into the cup-shaped polishing disc 1, starting the spindle motor 17 and adjusting rotating speed of the spindle motor 17 to 20 rpm to drive the eccentric spindle 43 to rotate, the rotation of the drive bearing 25 forcing the synchronous rotary drive disc 8 to swing, the swing of the synchronous rotary drive disc 8 forcing each flexible eccentric rotating shaft 19 to rotate simultaneously, the rotation of the flexible eccentric rotating shaft (19) forcing the magnetic pole 21 to rotate under the magnet rotating eccentric distance 53 so as to realize the transition from a dynamic magnetic field to a static magnetic field at the end face of the magnetic pole 21; the magnetorheological fluid forming a flexible polishing pad 64 with abrasive real-time renewing and self-sharpening and shape recovering under the effect of the dynamic magnetic field;

5) starting the transmission shaft motor 37 and adjusting the rotating speed of the transmission shaft motor 37 to 400 rpm to drive the cup-shaped polishing disc 1 to rotate at high speed; adjusting the rotating speed of the tool head 62 to −300 rpm, the swinging speed of the tool head 62 to 10 times/min and the swinging of the tool head 62 to 20 mm; finishing the single crystal silicon for 60 minutes to completing high-efficiency polishing of surface material of the single crystal silicon and obtaining an ultra-smooth and uniform surface with a roughness of Ra 0.3 nm.

Embodiment 2

FIG. 3 shows a self-sharpening polishing device with magnetorheological flexible polishing pad formed by dynamic magnetic field which comprises a polishing disc revolution mechanism and a multi-magnetic-pole synchronous rotary drive mechanism. The polishing disc revolution mechanism is composed of a base 39, a transmission shaft motor 37 being fitted onto the base 39 by tenth fixing screws 38, a transmission shaft driving belt wheel 50 being fitted onto the transmission shaft motor 37 by a second flat key 49, a bearing block 16 being installed vertically at the center of the base 39, a pair of transmission shaft bearings 33 being installed into the bearing block 16, a bearing end cap 14 being installed on an end face of the bearing block 16 by fifth fixing screws 15 such that it presses against an outer ring of the transmission shaft bearing 33, an inner fixing sleeve 34 and an outer fixing sleeve 35 supporting and separating the transmission shaft bearings 33, a transmission shaft 13 cooperating with the transmission shaft bearings 33, a transfer disc 11 being fitted coaxially onto an upper end face of the transmission shaft 13 by fourth fixing screws 12, an eccentric shaft fixing disc 3 being fitted coaxially onto an upper end face of the transfer disc 11 by second fixing screws 4, a cup-shaped polishing disc 1 being fitted coaxially onto an upper end face of the eccentric shaft fixing disc 3 by first fixing screws 2, a transmission shaft driven belt wheel 47 being fitted onto a lower end face of the transmission shaft 13 by twelfth fixing screws 46, and a transmission shaft transmission belt 48. The multi-magnetic-pole synchronous rotary drive mechanism consists of an eccentric spindle 43 being fitted into the transmission shaft 13 by a pair of spindle bearings 30, an inner sleeve 31 and an outer sleeve 32 positioning inner rings and outer rings of the spindle bearings 30, an eccentric spindle end cap 28 being fitted onto the upper end of the transmission shaft 13 by ninth fixing screws 29 such that it presses against the outer ring of the spindle bearing 30, a drive bearing 25 being fitted onto an end of an eccentric shaft of the eccentric spindle 43, a spindle end cap 24 being fitted onto an upper end of the eccentric shaft of the eccentric spindle 43 by seventh fixing screws 23 such that it presses against an inner ring of the drive bearing 25, a synchronous rotary drive disc 8 being fixed by an outer ring of spindle end cap 24, radial-thrust bearings 6 being installed in arrayed holes of the synchronous rotary drive disc 8, outer spacer bushings 7 separating outer rings of the radial-thrust bearings 6, flexible eccentric rotating shafts 19 being fixed by the radial-thrust bearings 6, shaft end caps 9 being fitted onto smaller ends of the flexible eccentric rotating shafts 19 by third fixing screws 10, a drive disc end cap 5 being fitted onto the upper end of the synchronous rotary drive disc 8 by eighth fixing screws 27 such that it presses against an outer ring of the radial-thrust bearing 6, deep groove ball bearings 22 being installed at larger upper ends of the flexible eccentric rotating shafts 19, eccentric sleeves 20 being fitted into eccentric holes at the larger upper ends of the flexible eccentric rotating shafts 19, magnetic poles 21 being fitted into the eccentric sleeves 20, an eccentric shaft fixing disc 3 in which the deep groove ball bearings 22 are installed by arrayed holes, a spindle driven belt wheel 45 being fitted onto a lower end of the eccentric spindle 43 by eleventh fixing screws 44 such that it presses against the spindle bearing 30, a spindle motor 17 being fitted onto the base 39 by a sixth fixing screw 18, a spindle driving belt wheel 40 being fitted onto the spindle motor 17 by a first flat key 41, and a spindle transmission belt 42.

FIGS. 3 and 6 shows that an eccentric distance 51 of the eccentric spindle, and an eccentric distance 52 of the flexible eccentric rotating shaft 19 are equal in numerical value, and the eccentric directions of all the flexible eccentric rotating shafts 19 are consistent and are opposite to the eccentric direction of the eccentric spindle 43.

A rule of arrangement the arrayed holes in the synchronous rotary drive disc 8 is equal to that of the arrayed holes in the eccentric shaft fixing disc 3; and a pitch-row of the arrayed holes in the synchronous rotary drive disc 8 is equal to that of the arrayed holes in the eccentric shaft fixing disc 3.

FIGS. 3 and 4 show that an outer cylinder of the flexible eccentric rotating shaft 19 has a boss 56, and the outer cylinder has an eccentric hole 55 inside, the eccentric distance 52 of the flexible eccentric rotating shaft is twice eccentricity 57 of the eccentric hole, three or more staggered thin notches 54 is provided between the outer cylinder of the flexible eccentric rotating shaft 19 and a small eccentric shaft 58 of the flexible eccentric rotating shaft 19 compensate for the manufacturing errors between the arrayed holes in the synchronous rotary drive disc 8 and those in the eccentric shaft fixing disc 3.

FIGS. 2 and 3 show that an eccentricity 57 of the eccentric hole of the flexible eccentric rotating shaft 19 is equal to an eccentricity of the eccentric sleeve 20; it can change from 0 to twice of the eccentricity of the eccentric sleeves 20 by adjusting the angel of rotation of the eccentric sleeve 20, the angle of rotation of each eccentric sleeve 20 is consistent with that of each flexible eccentric rotating shaft 19, the rotation of the eccentric spindle 43 forces the synchronous rotary drive disc 8 to swing, the swing of the synchronous rotary drive disc 8 forces each flexible eccentric shaft 19 to rotate simultaneously; the flexible eccentric rotating shaft 19 forces the magnetic pole 21 to rotate under a magnet rotating eccentric distance 53 so as to realize the transition from a dynamic magnetic field to a static magnetic field at the end face of the magnetic pole 21.

FIG. 5 shows that the transmission shaft 13 has a lower flange block 59 at the upper end, and the bearing end cap 14 has an upper flange block 60 in clearance fit with the lower flange block 59 to keep the transmission shaft bearing 33 waterproof and dustproof.

The magnetic poles 21 are cylindrical flat-end permanent magnet with a minimum magnetic field strength of 500 Gs and a diameter ranging from 5 mm to 50 mm; the minimum number of magnetic poles 21 is one, the number of the magnetic poles 21 is determined by the size of the object to be finished and the size of the cup-shaped polishing disc 1; the magnetic poles 21 are arranged in the eccentric shaft fixing disc 3 according to a certain rule with the end faces of the magnetic poles 21 being kept in the same plane.

The cup-shaped polishing disc 1, the eccentric shaft fixing disc 3, the flexible eccentric rotating shafts 19, and the eccentric sleeves 20 may be made of diamagnetic materials, i.e., stainless steel, magnalium alloy, or ceramic.

FIG. 7 shows a polishing method of the self-sharpening polishing device with magnetorheological flexible polishing pad formed by dynamic magnetic field, which consists of the following steps:

1) selecting 12 magnetic poles 21 with a diameter of 15 mm and a magnetic field strength of 2800 Gs based on the characteristic of a single crystal silicon carbide with a diameter of 100 mm, installing the 12 magnetic poles 21 into the self-sharpening polishing device with magnetorheological flexible polishing pad formed by dynamic magnetic field by arranging them into one equi-distant annular row, adjusting the angle of the eccentric sleeves 20 such that all the magnet rotating eccentric distances 53 are 1 mm;

2) installing the single crystal silicon carbide with a diameter of 100 mm onto a tool head 62, with a lower surface of the workpiece 61 being parallel to an upper end face of the cup-shaped polishing disc 1, adjusting a gap between the lower surface of the workpiece 61 and the cup-shaped polishing disc 1 to be 1 mm, with the center of the single crystal silicon carbide facing toward the center of the annular magnetic poles 21;

3) adding diamond abrasive with a particle size of 4 microns and a concentration of 4 wt %, and diamond abrasive with a particle size of 200 nanometers and a concentration of 2 wt %, into deionized water, adding carbonyl iron powder with a particle size of 500 nanometers and a concentration of 3 wt % and carbonyl iron powder with a particle size of 4 microns and a concentration of 3 wt % into the deionized water, and adding a dispersing agent with a concentration of 3 wt % and an anti-rusting agent with a concentration of 3 wt %; stirring the deionized water thoroughly and then ultrasonically vibrating the deionized water for 25 minutes to form the magnetorheological fluid 63;

4) pouring the magnetorheological fluid 63 into the cup-shaped polishing disc 1, starting the spindle motor 17 and adjusting rotating speed of the spindle motor 17 to 25 rpm to drive the eccentric spindle 43 to rotate, the rotation of the drive bearing 25 forcing the synchronous rotary drive disc 8 to swing, the swing of the synchronous rotary drive disc 8 forcing each flexible eccentric rotating shaft 19 to rotate simultaneously the rotation of the flexible eccentric rotating shaft 19 forcing the magnetic pole 21 to rotate under the magnet rotating eccentric distance 53 so as to realize the transition from a dynamic magnetic field to a static magnetic field at the end face of the magnetic pole 21, the magnetorheological fluid forming a flexible polishing pad 64 with abrasive real-time renewing and self-sharpening and shape recovering under the effect of the dynamic magnetic field;

5) starting the transmission shaft motor 37 and adjusting the rotating speed of the transmission shaft motor 37 to 350 rpm to drive the cup-shaped polishing disc 1 to rotate at a high speed, adjusting the rotating speed of the tool head 62 to 0 rpm, the swinging speed of the tool head 62 to 0 times/min, finishing the single crystal silicon carbide for 100 minutes to complete annular polishing of surface material of the single crystal silicon carbide; observing the polishing ring with optical microscopy to determine if there is any sub-surface damage to the single crystal silicon carbide.

Embodiment 3

The difference between embodiment 3 of the present invention and embodiment 1 lie in that: embodiment 3 describes a 100 mm single crystal sapphire being polished. A polishing method of the self-sharpening polishing device with magnetorheological flexible polishing pad formed by dynamic magnetic field comprises steps of:

1) selecting one magnetic pole 21 with a diameter of 15 mm and a magnetic field strength of 3000 Gs based on the characteristic of a single crystal sapphire with a diameter of 100 mm, installing place the magnetic pole 21 into the self-sharpening polishing device with magnetorheological flexible polishing pad formed by dynamic magnetic field adjusting the angle of the eccentric sleeve 20 such that the magnet rotating eccentric distance 53 is 1.5 mm, as shown in FIG. 7;

2) installing the single crystal sapphire with a diameter of 100 mm onto a tool head 62 with a lower surface of a workpiece 61 being parallel to an upper end face of the cup-shaped polishing disc 1, adjusting a gap between the lower surface of the workpiece 61 and the cup-shaped polishing disc 1 to be 1 mm, with the center of the single crystal sapphire facing toward the centre of the magnetic pole 21;

3) adding diamond abrasive with a particle size of 5 microns and a concentration of 3 wt %, diamond abrasive with a particle size of 0.8 microns and a concentration of 3 wt %, and diamond abrasive with a particle size of 200 nanometers and a concentration of wt 3%, into the deionized water, adding carbonyl iron powder with a particle size of 500 nanometers and a concentration of 4 wt %, and carbonyl iron powder with a particle size of 5 microns and a concentration of 3 wt %, into deionized water, and adding a dispersing agent with a concentration of 3 wt % and an anti-rusting agent with a concentration of 4 wt %; stirring the deionized water thoroughly and then ultrasonically vibrating the deionized water 25 minutes to form a magnetorheological fluid 63;

4) pouring the magnetorheological fluid 63 into the cup-shaped polishing disc 1, starting the spindle motor 17 and adjusting rotating speed of the spindle motor 17 to 50 rpm to drive the eccentric spindle 43 to rotate, the rotation of the drive bearing 25 forcing the synchronous rotary drive disc 8 to swing, the swing of the synchronous rotary drive disc 8 forcing the flexible eccentric rotating shaft 19 to rotate simultaneously, the rotation of the flexible eccentric rotating shaft 19 forcing the magnetic pole 21 to rotate under the eccentric magnet rotating eccentric distance 53 so as to realize the transition from a dynamic magnetic field to a static magnetic field at the end face of the magnetic pole 21, the magnetorheological fluid forming a flexible polishing pad 64 with abrasive real-time renewing, and self-sharpening and shape recovering under the effect of the dynamic magnetic field;

5) starting the transmission shaft motor 37 and adjusting the rotating speed of the transmission shaft motor 37 to 0 rpm to drive the cup-shaped polishing disc 1 to rotate at a high speed, adjusting the rotating speed of the tool head 62 to 400 rpm and the swinging speed of the tool head 62 to 0 times/min, finishing the single crystal sapphire for 60 minutes to complete fixed-point polishing of the surface material, observing the ring formed by polishing via optical microscopy, detecting the material removal rate and establishing the model using the single-point magnetic pole 21 to remove material from the single crystal sapphire.

These embodiments explain how a self-sharpening polishing device with magnetorheological flexible polishing pad formed by dynamic magnetic field and polishing method thereof according to the present invention, transforms a static magnetic field into a dynamic magnetic field by means of the eccentric rotation of a magnetic pole which rearranges the magnetic chain of the polishing pad so that the abrasive can renew itself, self-sharpen itself, and renew its shape in real time, thus solving the core problem that a polishing pad formed by a static magnetic field loses its finishing pressure on the workpiece due to deformation caused by viscosity and magnetism in the magnetorheological fluid.

The use of a multi-magnetic-pole synchronous rotary drive mechanism enables the close arrangement of numerous synchronous rotating magnetic poles into a large, flexible and compact polishing pad which can polish the plane of optical elements with large diameter. At the same time, by selecting magnetic poles with different magnetic field strengths, as well as different diameters and different quantities, it can realize single-point polishing, annular polishing, and regional polishing of the workpiece according to different arranging rules; all of which are suitable for studying the material removal mechanism of planar optical materials and sub-surface damage detection and for other experimental studies to meet the needs of scientific researches and practical industrial applications. Moreover, this invention does not need to renew the magnetorheological fluid during the finishing process, which saves the space of equipment and the cost of finishing. As can be seen, this invention is a clever concept that is convenient, easy to use, and delivers an extremely high surface finishing; this is a revolutionary high precision and high efficiency method for polishing optical elements with large diameter.

It should be noted that the above embodiments are only detailed description of the present invention and should not be construed as limitations to this invention. For the person skilled in the art, various changes in form and detail may be made without departing from the spirit and scope of the claims.

What is claimed:

1. A self-sharpening polishing device with magnetorheological flexible polishing pad formed by dynamic magnetic field, wherein the self-polishing device comprises a polishing disc revolution mechanism and a multi-magnetic-pole synchronous rotary drive mechanism, the polishing disc revolution mechanism comprising a base, a transmission shaft motor, a transmission shaft, a transfer disc, an eccentric shaft fixing disc, a cup-shaped polishing disc and a transmission shaft transmission mechanism, the multi-magnetic-pole synchronous rotary drive mechanism comprising an eccentric spindle, a synchronous rotary drive disc, flexible eccentric rotating shafts, eccentric sleeves, magnetic poles, the eccentric shaft fixing disc, a spindle motor, and a spindle transmission mechanism, wherein the transmission shaft motor is fitted onto the base, a driving transmission member of the transmission shaft transmission mechanism is fitted onto an output shaft of the transmission shaft motor, a driven transmission member of the transmission shaft transmission mechanism is connected to the transmission shaft, the transfer disc is fitted coaxially onto an upper end face of the transmission shaft, the eccentric shaft fixing disc is fitted coaxially onto an upper end face of the transfer disc, the cup-shaped polishing disc is fitted coaxially onto an upper end face of the eccentric shaft fixing disc, the spindle motor of the multi-magnetic-pole synchronous rotary drive mechanism is fitted onto the base, a driving transmission member of the spindle transmission mechanism is fitted onto an output shaft of the spindle motor, a driven transmission member of the spindle transmission mechanism is connected to the eccentric spindle, the eccentric spindle is mounted in a hollow cavity inside the transmission shaft, the synchronous rotary drive disc is fitted onto an upper end of the transmission shaft, the flexible eccentric rotating shaft is installed onto an upper end of the synchronous rotary drive disc, the eccentric sleeve is fitted onto the flexible eccentric rotating shaft, the magnetic pole is fitted inside the eccentric sleeve, and the flexible eccentric rotating shaft is mounted in a shaft hole inside the cup-shaped polishing disc.

2. The self-sharpening polishing device with magnetorheological flexible polishing pad formed by dynamic magnetic field of claim 1, wherein said spindle transmission mechanism comprises a spindle driving belt wheel, a spindle transmission belt, and a spindle driven belt wheel, wherein the spindle driving belt wheel is mounted on the output shaft of the spindle motor, the spindle driven belt wheel is mounted on the eccentric spindle, and the spindle transmission belt is wound around the spindle driving belt wheel and the spindle driven belt wheel.

3. The self-sharpening polishing device with magnetorheological flexible polishing pad formed by dynamic magnetic field of claim 1, wherein said transmission shaft transmission mechanism comprises a transmission shaft driving belt wheel, a transmission shaft driven belt wheel, and a transmission shaft transmission belt, wherein the transmission shaft driving belt wheel is mounted on an output shaft of the transmission shaft, the transmission shaft driven belt wheel is mounted on the transmission shaft, and the transmission shaft transmission belt is wound around the transmission shaft driving belt wheel and the transmission shaft driven belt wheel.

4. The self-sharpening polishing device with magnetorheological flexible polishing pad formed by dynamic magnetic field of claim 1, wherein said transmission shaft motor is fitted onto the base by tenth fixing screws, the transmission shaft driving belt wheel is fitted onto the transmission shaft motor by a second flat key, a bearing block in which a pair of transmission shaft bearings are installed is installed vertically at the center of the base, a bearing end cap is mounted on an end face of the bearing block by fifth fixing screws such that the bearing end cap presses against an outer ring of the transmission shaft bearing, an inner fixing sleeve and an outer fixing sleeve support and separate the transmission shaft bearings on which the transmission shaft is supported, the transfer disc is fitted coaxially onto the upper end face of the transmission shaft by fourth fixing screws, the eccentric shaft fixing disc is fitted coaxially onto the upper end face of the transfer disc by second fixing screws, the cup-shaped polishing disc is fitted coaxially onto the upper end face of the eccentric shaft fixing disc by first fixing screws, a transmission shaft driven belt wheel is fitted onto a lower end face of the transmission shaft by twelfth fixing screws, the eccentric spindle of the multi-magnetic-pole synchronous rotary drive mechanism is fitted inside the hollow cavity inside the transmission shaft by a pair of spindle bearings, an inner sleeve and an outer sleeve position inner rings and outer rings of the spindle bearings, an eccentric spindle end cap is fitted onto the upper end of the transmission shaft by ninth fixing screws such that the eccentric spindle end cap presses against the outer ring of the spindle bearing, a drive bearing is fitted onto an end of an eccentric shaft of the eccentric spindle, a spindle end cap is fitted onto an upper end of the eccentric shaft of the eccentric spindle by seventh fixing screws such that the spindle end cap presses against an inner ring of the drive bearing, the synchronous rotary drive disc is fitted onto an outer ring of the drive bearing by a drive disc end cap, radial-thrust bearings are installed in arrayed holes of the synchronous rotary drive disc, outer spacer bushings separate outer rings of the radial-thrust bearings, the flexible eccentric rotating shaft is fixed by the radial-thrust bearing, a shaft end cap is fitted onto a smaller lower end of the flexible eccentric rotating shaft by third fixing screws, the drive disc end cap is fitted onto the upper end of the synchronous rotary drive disc by eighth fixing screws such that the drive disc end cap presses against the outer ring of the radial-thrust bearing, a deep groove ball bearing is installed at a larger upper end of the flexible eccentric rotating shaft, the eccentric sleeve into which the magnetic pole is fixed, is fitted into the eccentric hole of the larger upper end of the eccentric rotating shaft, the deep groove ball bearings are installed in the eccentric shaft fixing disc by means of arrayed holes, the spindle driven belt wheel is fitted onto a lower end of the eccentric spindle by eleventh fixing screws such that the spindle driven belt wheel presses against the spindle bearing, the spindle motor is fitted onto the base by a sixth fixing screw, and the spindle driving belt wheel is fitted onto the spindle motor by a first flat key.

5. The self-sharpening polishing device with magnetorheological flexible polishing pad formed by dynamic magnetic field of claim 1, wherein an eccentric distance of the eccentric spindle and an eccentric distance of the flexible eccentric rotating shaft are equal in numerical value, and the eccentric directions of all the flexible eccentric rotating shafts are consistent and opposite to the eccentric direction of the eccentric spindle.

6. The self-sharpening polishing device with magnetorheological flexible polishing pad formed by dynamic magnetic field of claim 1, wherein a rule of arrangement of the arrayed holes in the synchronous rotary drive disc is equal to that of the arrayed holes in the eccentric shaft fixing disc, and a pitch-row of the arrayed holes in the synchronous rotary drive disc is equal to that of the arrayed holes in the eccentric shaft fixing disc.

7. The self-sharpening polishing device with magnetorheological flexible polishing pad formed by dynamic magnetic field of claim 5, wherein an outer cylinder of the flexible eccentric rotating shaft has a boss, the outer cylinder has an eccentric hole inside, the eccentric distance of the flexible eccentric rotating shaft is twice of an eccentricity of the eccentric hole, and three or more staggered thin notches is provided between the outer cylinder of the flexible eccentric rotating shaft and a small eccentric shaft of the flexible eccentric rotating shaft to compensate for the manufacturing error between the arrayed holes in the synchronous rotary drive disc and the arrayed holes in the eccentric shaft fixing disc.

8. The self-sharpening polishing device with magnetorheological flexible polishing pad formed by dynamic magnetic field of claim 1, wherein an eccentricity of the eccentric hole of the flexible eccentric rotating shaft is equal to an eccentricity of the eccentric sleeve; the eccentricity of the eccentric hole of the flexible eccentric rotating shaft can change from 0 to twice of the eccentricity of the eccentric sleeve by adjusting the angle of rotation of the eccentric sleeve, the angle of rotation of each eccentric sleeve is consistent with that of each flexible eccentric rotating shaft, the rotation of the eccentric spindle forces the synchronous rotary drive disc to swing, the swing of the synchronous rotary drive disc forces each flexible eccentric rotating shaft to rotate simultaneously, and the rotation of the flexible eccentric rotating shaft forces the magnetic pole to rotate under a magnet rotating eccentric distance so as to realize the transition from a dynamic magnetic field to a static magnetic field at the end face of the magnetic pole.

9. The self-sharpening polishing device with magnetorheological flexible polishing pad formed by dynamic magnetic field of claim 8, wherein the transmission shaft has a lower flange block at the upper end, the bearing end cap has an upper flange block in clearance fit with the lower flange block to keep the transmission shaft bearing waterproof and dustproof, said magnetic poles are cylindrical flat-end permanent magnet with a minimum magnetic field strength of 500 Gs and a diameter ranging from 5 mm to 50 mm, the minimum number of magnetic poles is one, the number of magnetic poles is determined by the size of the object to be finished and the size of the cup-shaped polishing disc, the magnetic poles are arranged in the an eccentric shaft fixing disc according to a certain rule with the end faces of the magnetic poles being kept in the same plane, and the cup-shaped polishing disc, the eccentric shaft fixing disc, the flexible eccentric rotating shafts, and the eccentric sleeves are made from diamagnetic materials, i.e., stainless steel, magnalium alloy, or ceramic.

10. A polishing method of the self-sharpening polishing device with magnetorheological flexible polishing pad formed by dynamic magnetic field of claim 1, wherein the polishing method comprises:

1) selecting magnetic poles with appropriate diameter and magnetic field strength based on characteristic of the object to be finished, installing the magnetic poles into the self-sharpening polishing device with magnetorheological flexible polishing pad formed by dynamic magnetic field, adjusting the angle of the eccentric sleeves based on requirements such that all the magnet rotating eccentric distances are consistent;
2) installing a workpiece onto a tool head, with a lower surface of the workpiece being parallel to an upper end face of the cup-shaped polishing disc, adjusting a gap between the lower surface of the workpiece and the cup-shaped polishing disc to range from 0.5 mm to 5 mm;
3) adding at least two of the following three abrasives into deionized water, wherein the three abrasives are micron-grade abrasive with a concentration ranging from 2 wt % to 15 wt %, sub-micron abrasive with a concentration ranging from 2 wt % to 15 wt %, and nanoscale abrasive with a concentration ranging from 2 wt % to 15 wt %, adding sub-micron carbonyl iron powder with a concentration ranging from 2 wt % to 20 wt % and micron-grade carbonyl iron powder with a concentration ranging from 3 wt % to 15 wt % into the deionized water, and adding a dispersing agent with a concentration ranging from 3 wt % to 15 wt %, and an anti-rusting agent with a concentration ranging from 1 wt % to 6 wt %; stirring the deionized water thoroughly and then ultrasonically vibrating the deionized water for 5 to 30 minutes to form a magnetorheological fluid;
4) pouring the magnetorheological fluid into the cup-shaped polishing disc, starting the spindle motor to drive the eccentric spindle to rotate, the rotation of the drive bearing forcing the synchronous rotary drive disc to swing, the swing of the synchronous rotary drive disc, forcing each flexible eccentric rotating shaft to rotate simultaneously; the rotation of the flexible eccentric rotating shaft forcing the magnetic pole to rotate under the magnet rotating eccentric distance so as to realize the transition from a dynamic magnetic field to a static magnetic field at the end face of the magnetic pole, the magnetorheological fluid forming a flexible polishing pad with abrasive real-time renewing and self-sharpening and shape recovering under the effect of the dynamic magnetic field;

5) starting the transmission shaft motor to drive the cup-shaped polishing disc to rotate at high speed, driving the tool head to rotate at high speed and swing in low speed to realize the high-efficiency, ultra-smooth and uniform polishing the surface material of the workpiece.

* * * * *